US007125050B2

(12) United States Patent
Yamamoto et al.

(10) Patent No.: US 7,125,050 B2
(45) Date of Patent: Oct. 24, 2006

(54) SHEET DIVIDERS WITH ENHANCED TABS

(75) Inventors: Norman C. Yamamoto, Yorba Linda, CA (US); Stuart A. Karten, Venice, CA (US); Eric G. Schmid, Los Angeles, CA (US); Ronald Ugolick, San Dimas, CA (US); Chia-Ee Alice Chou, Walnut, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/965,437

(22) Filed: Oct. 12, 2004

(65) Prior Publication Data

US 2005/0077720 A1 Apr. 14, 2005

Related U.S. Application Data

(60) Provisional application No. 60/510,625, filed on Oct. 10, 2003.

(51) Int. Cl.
*B42F 21/00* (2006.01)

(52) U.S. Cl. ..... 283/36; 40/641

(58) Field of Classification Search ..... 283/36–43, 283/107; 40/641, 359; 229/67.1, 74; 402/79
See application file for complete search history.

(56) References Cited

U.S. PATENT DOCUMENTS

| | | | |
|---|---|---|---|
| 943,720 | A | 12/1909 | Vick |
| 958,050 | A | 5/1910 | Whipple |
| 1,495,401 | A | 5/1924 | Cushing |
| 1,705,753 | A | 3/1929 | Dawson |
| 1,785,780 | A | 12/1930 | Maish |
| 2,420,021 | A | 5/1947 | Straubel et al. |
| 3,054,202 | A | 9/1962 | Scholfield |
| 3,205,597 | A | 9/1965 | Stern |

(Continued)

FOREIGN PATENT DOCUMENTS

| | | | |
|---|---|---|---|
| EP | 0 328 751 | A2 | 11/1988 |

(Continued)

OTHER PUBLICATIONS

Product Packaging: ACCO Brands, Inc., "view tab transparent dividers," copyright 2000.

(Continued)

*Primary Examiner*—Boyer D. Ashley
*Assistant Examiner*—J Williams
(74) *Attorney, Agent, or Firm*—Ingrassia, Fisher & Lorenz

(57) ABSTRACT

A sheet divider may include a sheet stock having an edge and a tab. The tab may be disposed at the edge of the sheet stock and have an opening. The opening is configured to enable a label to be inserted into the tab from a direction that is substantially perpendicular to the edge of the sheet stock. For example, a label may be inserted into the tab from a direction of the sheet stock. In other words, a label may be inserted in a direction that is substantially perpendicular to the edge of the sheet stock. The tab may include a projecting portion that extends beyond the edge of the sheet stock and that is free of openings. A pocket may be formed in the projecting portion to receive a label. In addition, the projecting portion may be curvilinear in shape. The labels may be relatively large so that a proximal portion extends out of the tab. The sheet stock may include retaining structure for retaining the corners of the proximal portion of the label against the sheet stock.

26 Claims, 10 Drawing Sheets

U.S. PATENT DOCUMENTS

| | | | | | |
|---|---|---|---|---|---|
| 3,263,688 | A | | 8/1966 | Anders | |
| 3,286,381 | A | | 11/1966 | Wooge | |
| 3,552,047 | A | | 1/1971 | Dalziel | |
| 3,566,522 | A | | 3/1971 | Leach et al. | |
| 3,683,533 | A | | 8/1972 | Kelly | |
| 3,747,242 | A | * | 7/1973 | Heimann | 40/641 |
| 4,019,759 | A | | 4/1977 | Stanton | |
| 4,137,658 | A | | 2/1979 | Wos | |
| 4,477,013 | A | | 10/1984 | Herrin | |
| 4,687,227 | A | | 8/1987 | Kehoe | |
| 4,784,508 | A | * | 11/1988 | Shannon | 402/79 |
| 4,951,408 | A | | 8/1990 | Banks | |
| 5,275,438 | A | | 1/1994 | Struhl | |
| D353,839 | S | | 12/1994 | Mullen | |
| 5,401,058 | A | | 3/1995 | Holmberg | |
| 5,513,457 | A | | 5/1996 | Byrnes et al. | |
| 5,545,087 | A | | 8/1996 | Seward | |
| 5,683,113 | A | | 11/1997 | Petrucci | |
| 5,692,670 | A | | 12/1997 | Ho | |
| 5,846,623 | A | | 12/1998 | Denny | |
| 5,875,579 | A | * | 3/1999 | Winzen | 40/641 |
| 5,953,843 | A | | 9/1999 | Collins et al. | |
| 5,996,881 | A | | 12/1999 | Smith | |
| 6,108,953 | A | * | 8/2000 | Hall | 40/359 |
| 6,244,628 | B1 | * | 6/2001 | Muller | 283/38 |
| 6,332,285 | B1 | | 12/2001 | Aaldenberg | |
| 6,375,604 | B1 | | 4/2002 | Verhines | |
| 6,390,715 | B1 | * | 5/2002 | Gerbasi | 402/79 |

FOREIGN PATENT DOCUMENTS

| | | |
|---|---|---|
| EP | 0 844 101 A1 | 5/1998 |

OTHER PUBLICATIONS

PCT International Search Report PCT/US2004/033967, Mar. 30, 2005.

* cited by examiner

SHEET DIVIDERS WITH ENHANCED TABS

CROSS REFERENCE TO RELATED APPLICATIONS

This application claims priority under 35 U.S.C. § 119(e) on U.S. Provisional Application for Patent Ser. No. 60/510,625 filed Oct. 10, 2003, which application is incorporated herein by reference.

BACKGROUND OF THE INVENTION

The present invention relates to sheet dividers with tabs in which a label may be inserted. The present invention also relates to a set of sheet dividers with tabs and a sheet of labels for use with the tabs.

Sheet dividers are widely used office products. A sheet divider is typically used in a binder to separate sheets of paper into desired categories or sections. A tab on the sheet divider is typically labeled to indicate the particular sections of the binder. The tab projects beyond the sheets of paper so that a user can easily access which desired section of paper to turn to.

FIGS. 1 and 2 illustrate a typical sheet divider 50 with a tab 52. The tab 52 is mounted to a side edge of a piece of sheet stock 54 in such a way that a sleeve 56 is formed in the tab. The sleeve 56 is open along its top and bottom edges. For the purposes of this discussion, the divider 50 has a longitudinal direction L parallel with the side edge of the sheet stock and a perpendicular transverse direction T as shown in FIG. 1. A label 58 as shown in FIG. 3 is typically folded and then inserted into the sleeve 56 in the longitudinal direction as indicated by arrows A and B in FIG. 1, i.e., in a direction parallel to the edge of the sheet stock 54.

Such conventional sheet dividers have a number of drawbacks. For example, the label 58 has the tendency to fall out of the tab 52, particularly when a binder utilizing such a sheet divider is stored or transported upright. Also, the label 58 has the tendency to bend or crease while being inserted into the sleeve 56. Further, it may be difficult to remove the label 58 from the tab 52 because of tight tolerances. In addition, because of the size of the label 58, a user is limited in how much information can be printed thereon. Still further, the shape of the tab 52 is limited to a rectangle because the top and bottom edges of the sleeve 52 need to be linear to accept a label.

Accordingly, there is a need for sheet dividers with tabs that easily allows a user to insert and remove labels from tabs and that allows a variety of shapes and sizes of tabs and complementary labels to be utilized. The present invention satisfies these needs.

BRIEF SUMMARY OF THE INVENTION

The present invention relates to sheet dividers with tabs in which a label may be inserted. The present invention also relates to a set of sheet dividers with tabs and a sheet of labels for use with the tabs.

According to one embodiment of the invention and by way of example only, a sheet divider may include a sheet stock having an edge and a tab. The tab may be disposed at the edge of the sheet stock and have an opening. The opening is configured to enable a label to be inserted into the tab from a direction that is substantially perpendicular to the edge of the sheet stock. For example, a label may be inserted into the tab from a direction of the sheet stock. The tab may include a projecting portion that extends beyond the edge of the sheet stock and that is free of openings. A pocket may be formed in the projecting portion to receive a label. In addition, the projecting portion may be substantially curvilinear.

According to another embodiment, a sheet divider includes a sheet stock having an edge and a tab disposed at the edge of the sheet stock. The tab may include a substantially curvilinear projecting portion that extends beyond the edge of the sheet stock and an opening that enables a label to be inserted into the projecting portion.

According to still other embodiments, the labels may be relatively large in a transverse direction so that a proximal portion thereof extends over the sheet stock when a distal portion is received in of the tab. The sheet stock may include retaining structure that is configured to retain the proximal portion of the label against the sheet stock.

One of the advantages of the sheet divider is that a label will not dislodge from the tab in a longitudinal direction (i.e., downwardly when a binder utilizing the sheet divider is stored upright). As the opening to the tab is directed to the sheet stock, the projecting portion is free of opening through which a label could dislodge.

Another advantage is that it is easier to insert and remove a label from the tab than with conventional dividers. In some of the embodiments, the opening may have a length that is longer than a width the projecting portion. Accordingly, this relationship facilitates the passage of the label into and out of the projecting portion. In addition, as the label may be configured complementarily to the tab, the label is less likely to buckle and bend when being inserted.

Still another advantage is that the shape of the tab is not limited to a rectangle because the projecting portion is free of opening through which the label may dislodge. Accordingly, the tab may be substantially curvilinear, such as a semicircular or arcuate. This enables any number of shapes to be utilized for the tab.

Other features and advantages of the present invention will become apparent to those skilled in the art from a consideration of the following detailed description taken in conjunction with the accompanying drawings.

DETAILED DESCRIPTION OF THE INVENTION

Figure 1:
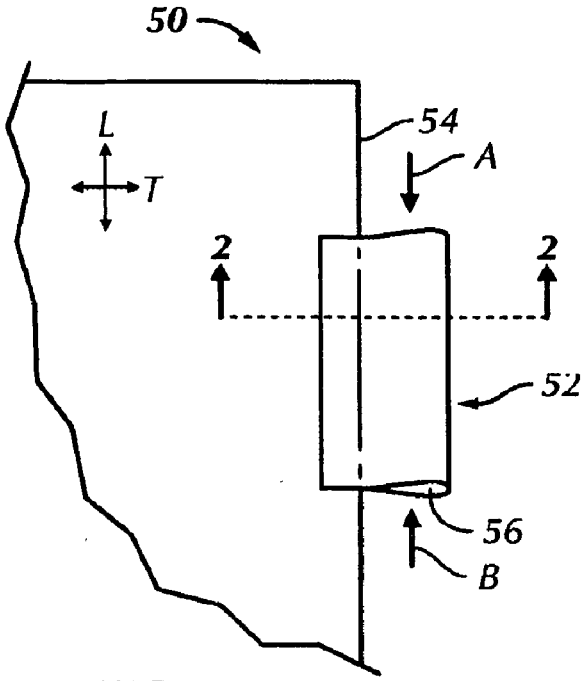
FIG. 1 (Prior Art)
FIG. 1 is a fragmentary perspective view illustrating a sheet divider with a tab according to the prior art.
Figure 2:
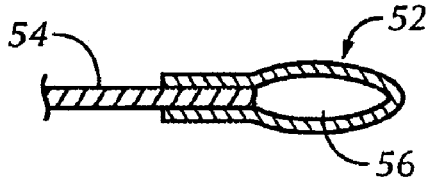
FIG. 2 (Prior Art)
FIG. 2 is a cross sectional view taken along line 2—2 of FIG. 1.
Figure 3:
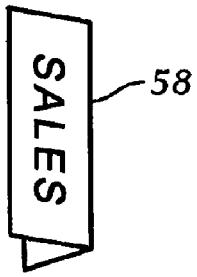
FIG. 3 (Prior Art)
FIG. 3 illustrates a label for a tabbed sheet divider according to the prior art.
Figure 4:
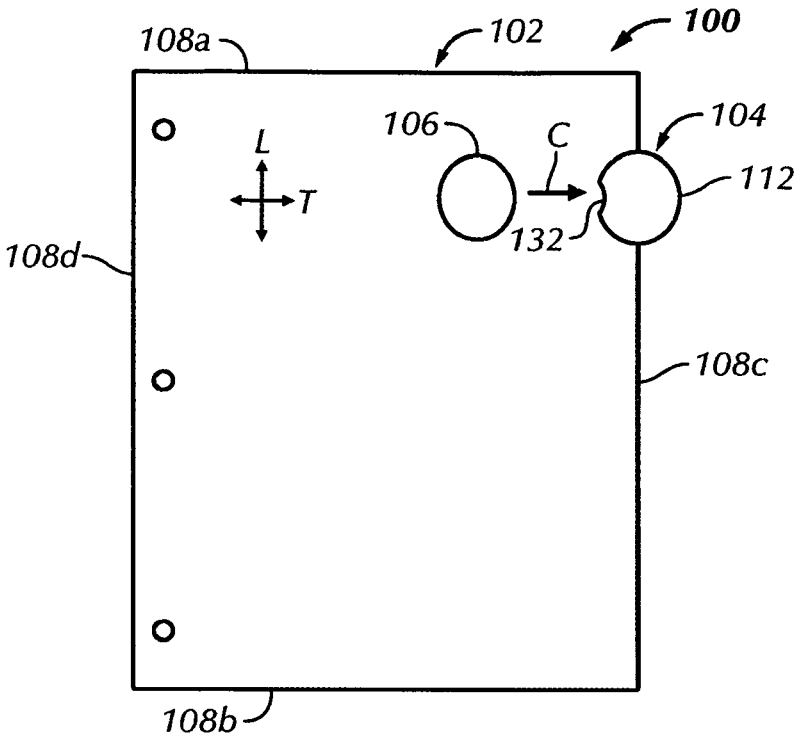
FIG. 4 is a plan view illustrating a sheet divider according to a number of embodiments.

Referring to the drawings, a sheet divider 100 is illustrated in FIG. 4 and includes a sheet stock 102 and a tab 104. In contrast to conventional tabbed dividers, the tab 104 is configured to enable a label 106 to be inserted into the tab 104 from the direction of the sheet stock 102 as indicated by arrow C.

The sheet stock 102 may be described as having a plurality of edges 108, such as a top edge 108*a*, a bottom edge 108*b*, and a pair of side edges 108*c* and 108*d*. For the purposes of this description, a longitudinal axis or direction, indicated by arrow L, may be defined between the top and bottom edges 108*a* and 108*b*, and a transverse axis or direction, indicated by arrow T, may be defined between the side edges 108*c* and 108*d*.

Figure 5:
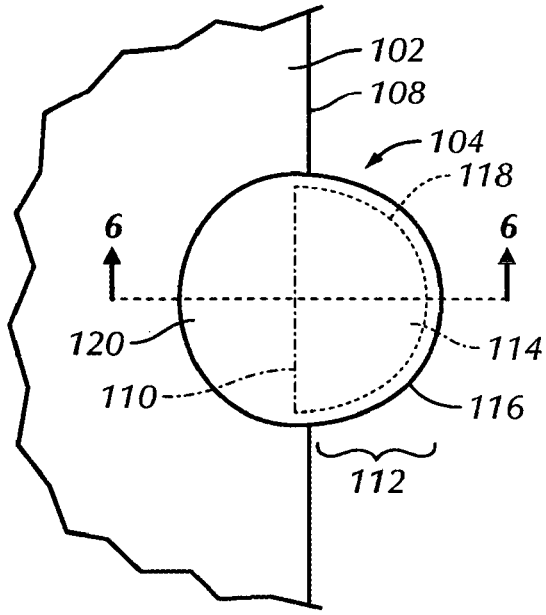
FIG. 5 is an enlarged fragmentary view illustrating one of the embodiments of a sheet divider with a tab.

With additional reference to FIG. 5, the tab 104 is disposed at one of the edges 108 of the sheet stock 102 (e.g., side edge 108*c*). With additional reference to FIGS. 6A and 6B, in a number of embodiments the tab 104 may include an opening 110 that enables the label 106 to be inserted into the tab 104 from a direction that is substantially perpendicular to the edge 108 of the sheet stock 102. For example, the opening 110 may open toward the sheet stock 102 to enable the label 106 to be inserted into the tab 104.

In some of the embodiments, the tab 104 may include a projecting portion 112 that extends transversely beyond the edge 108 of the sheet stock 102. The tab 104 may also include a pocket 114 formed in the projecting portion 112, which is particularly shown in FIGS. 6A and 6B. The projecting portion 112 may be configured so that the opening 110 extends substantially longitudinally such that a 106 label is insertable into the pocket 114 in the transverse direction.

Figure 7A:
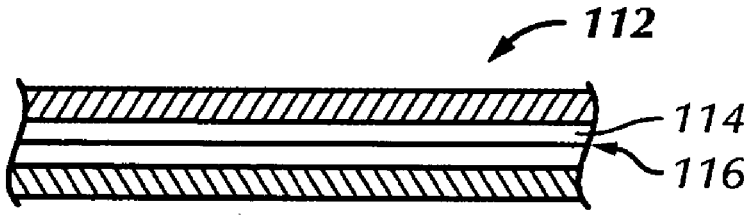
FIGS. 7A and 7B are alternative cross-sectional views taken along line 7—7 of FIG. 6A.
Figure 7B:
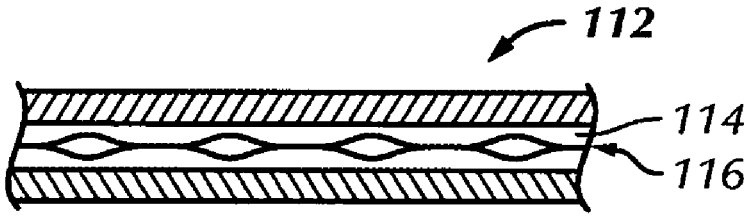

The projecting portion 112 may have an outer edge 116. With additional reference to FIGS. 7A and 7B, in a number of embodiments the edge 116 of the projecting portion 112 may be closed, for example, to form the pocket 114. As shown in FIG. 7A, the edge 116 may be closed or sealed along a substantially continuous extent thereof. Alternatively, as shown in FIG. 7B, the edge 116 may be closed intermittently along an extent thereof. The edge 116 may be closed by welding as indicated by dashed line 118 in FIG. 5, or by any other know means. In either embodiment, the projecting portion 112 is free of openings that would allow a label to dislodge therefrom in a longitudinal direction.

Figure 8:
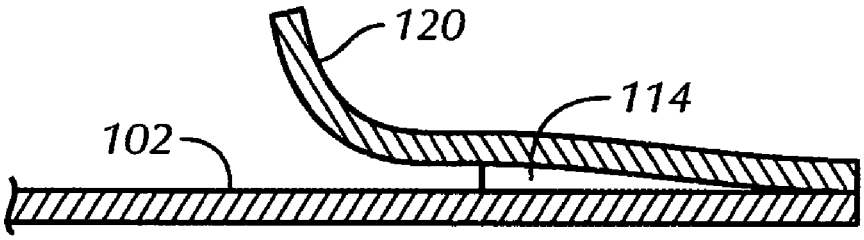
FIG. 8 is a fragmentary cross-sectional view of another embodiment of a tab of a sheet divider.

In some of the embodiments, the opening 110 may be located spatially inside or inward of the edge 108 of the sheet stock 102. For example, as shown in FIG. 5, the welding 118 may continue spatially past the edge 108 of the sheet stock 102, with the opening 110 being defined between ends of the welding 118 as shown in phantom line. In other embodiments, the tab 104 may include a flap 120 that projects inwardly from the edge 108 of the sheet stock 102 and that is able to be lifted away from the sheet stock, as shown in FIG. 8.

With reference to FIGS. 4 and 5, in a number of embodiments the tab 104 may be substantially curvilinear in shape. Prior to the present invention, it was not possible to have a curvilinear tab because conventional sleeve-type tabs would not be able to retain a label. In curvilinear embodiments, the projecting portion 112 of the tab 104 may be, for example, semicircular, arcuate, semi-ovoid, or other curved shaped.

Figure 9:
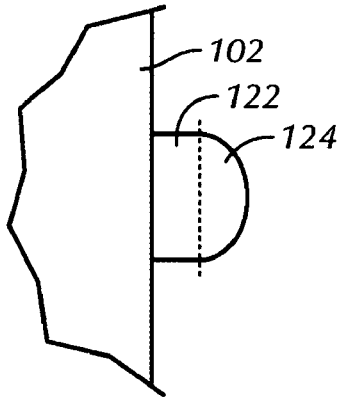
FIG. 9 is a fragmentary plan view illustrating other embodiments of a sheet divider with a tab.

In other embodiments such as shown in FIG. 9, the projecting portion 112 of the tab 104 may include a rectilinear portion 122 and a curvilinear portion 124 (which for illustrative purposes are shown separated by the dashed line). The curvilinear portion 124 is distal to the edge 108 of the sheet stock 102, with the rectilinear portion 122 positioned between the curvilinear portion 124 and the sheet stock 102.

Figure 10:
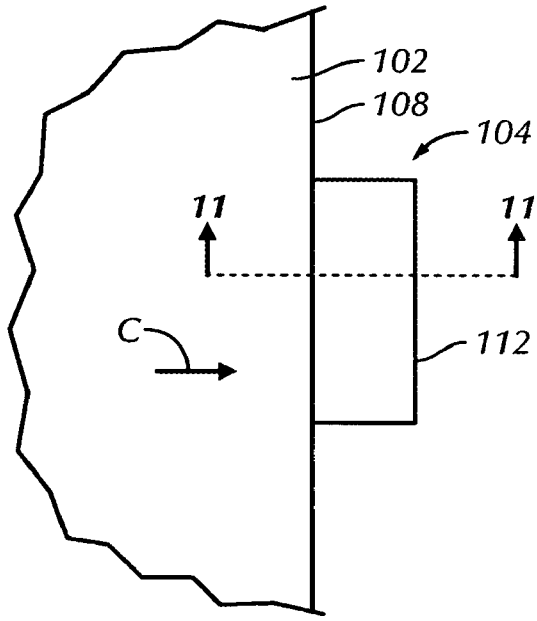
FIG. 10 is a fragmentary plan view illustrating still other embodiments of a sheet divider with a tab.
Figure 11:
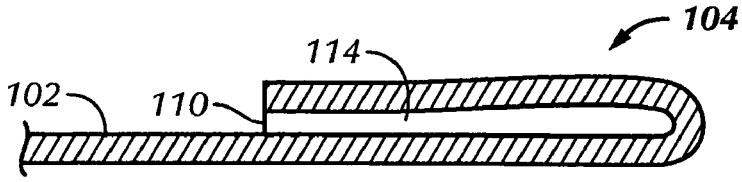
FIG. 11 is a cross-sectional view taken along line 11—11 of FIG. 10.

Referencing FIGS. 10 and 11, in still other embodiments the projecting portion 112 of the tab 104 may be substantially rectilinear. Analogous to curvilinear embodiments, the opening 110 of the tab 104 may be configured to enable a label to be inserted into the pocket 114 in a direction that is substantially perpendicular to the edge 108 of the sheet stock 102 as indicated by arrow C.

Figure 12:
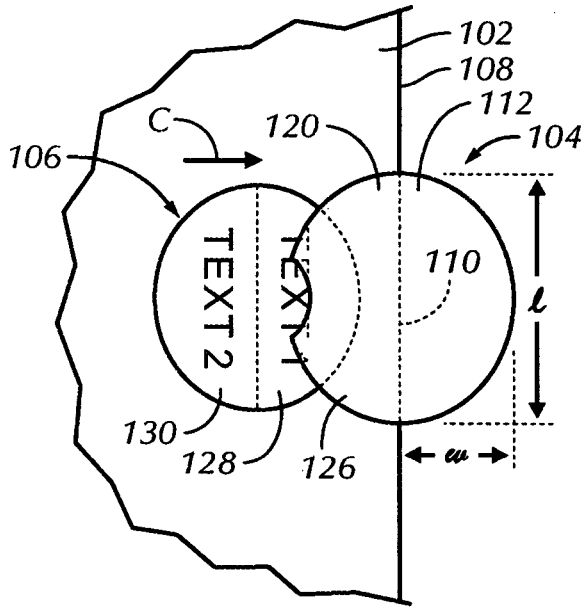
FIG. 12 is a fragmentary plan view illustrating some of the embodiments of a sheet divider with a tab, with a label being inserted into the tab.

In still other embodiments such as shown in FIG. 12, the tab 104 may include a divider portion 126 that projects inwardly from the edge 108 and is spatially positioned over a portion of the sheet stock 102. The divider portion 126 may include the flap 120 described above. In the embodiments shown in FIG. 12, the divider portion 126 may be substantially curvilinear.

Figure 13:
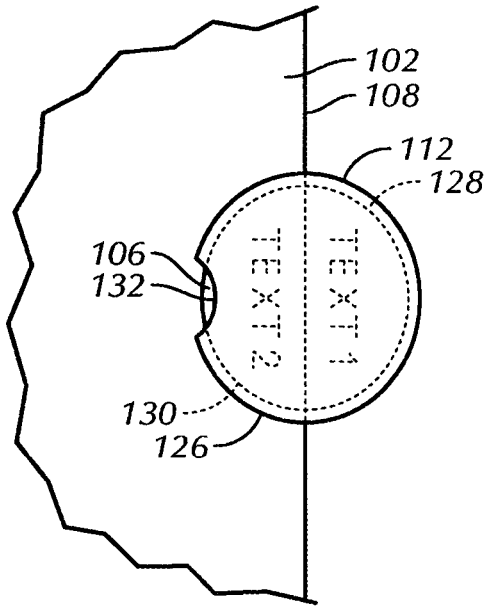
FIG. 13 is a view similar to that of FIG. 12, illustrating a label received by the tab.

As also shown in FIG. 12, in further embodiments the label 106 may be shaped complementary to the projecting portion 112 and the divider portion 126 such that when received in the tab 104, the label 106 is substantially coextensive with the pocket 114 as shown in FIG. 13. For example, in the curvilinear embodiment shown, the label 106 may be substantially curvilinear.

As also shown in FIG. 12, the opening 110 to the projecting portion 112 may be elongate in the longitudinal direction. In other words, the opening 110 may have a great length l in the longitudinal direction than a width w of the projecting portion 112 in the transverse direction. Accordingly, the label 106 may also be longer in the longitudinal direction than in the transverse direction. The longitudinally longer opening 110 may facilitate the insertion and removal of the label 106 into the tab 104. In addition, the label 106 is less likely to buckle during insertion because of the shorter transverse direction.

As particularly shown in FIG. 13, the label 106 may be visible in the tab 104 both at the projection portion 112 and the divider portion 126. In this regard, the label 106 may include a projecting section 128 and a divider section 130. Further, different text or indicia may be printed on the sections 128 and 130. Accordingly, in embodiments in which the divider 100 is received in a binder (not shown), the projecting section 128 is visible when the binder is closed, and the divider section 130 is visible when the binder is opened to the divider 100. As particularly shown in FIG. 13, the flap 120 may include a notch 132 that provides access to the label 106 when received in the pocket 114. As also shown in FIG. 13, as the opening 110 opens toward the sheet stock 102, the label 106 is prevented from dislodging from the tab 104 in the longitudinal direction.

Figure 6A:
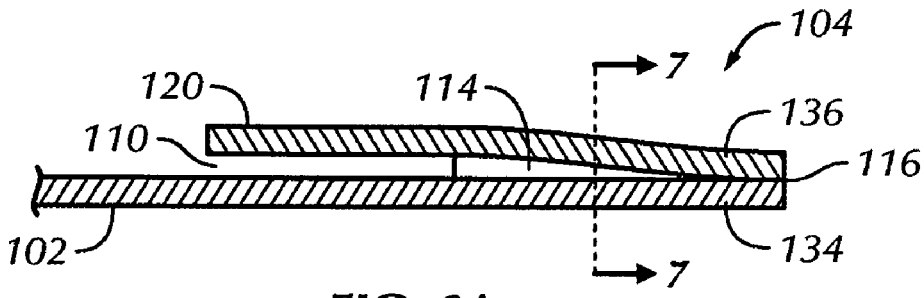
FIGS. 6A, 6B, and 6C are alternative cross-sectional views taken along line 6—6 of FIG. 5.
Figure 6B:
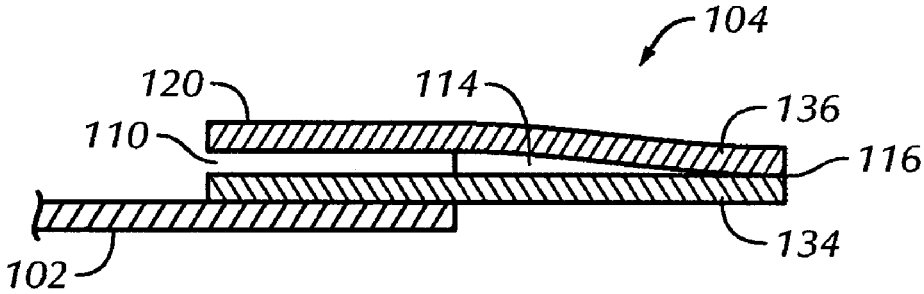

With further reference to FIGS. 6A and 6B, in a number of embodiments the tab 104 may include a stock portion 134 and a pocket portion 136. The stock portion 134 is disposed at and extends outwardly from one of the edges 108 of the stock sheet 102. In some of the embodiments, the stock portion 134 may be unitary with the sheet stock 102 as shown in FIG. 6A such that the sheet stock 102 and the stock portion 134 comprise a single element. In other embodiments, the stock portion 134 may be fixed or attached to the sheet stock 102 as shown in FIG. 6B, for example, by adhesive, welding, use of heat, and so on. The pocket portion 136 may then be attached to the stock portion 134 to form a pocket 114.

Figure 6C:
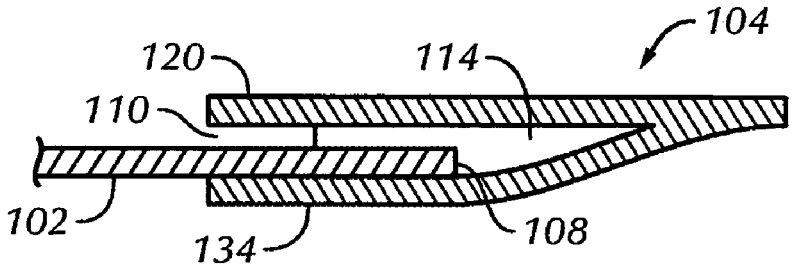

It still other embodiments, the stock portion 134 may be fixed or attached to a back side of the sheet stock 102, with the pocket portion 136 extending over a front side of the stock sheet 102, thereby sandwiching the edge 108 of the sheet stock therebetween as shown in FIG. 6C. The pocket portion 136 may be attached to the front side of the sheet stock 102 and the stock portion 134, for example, as indicated by weld line 118 in FIG. 5.

Figure 14:
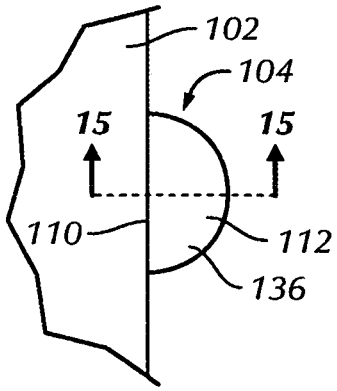
FIG. 14 is a fragmentary plan view illustrating still other embodiments of a sheet divider with a tab.
Figure 15:
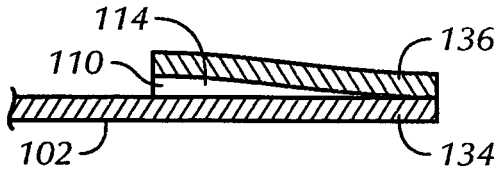
FIG. 15 is a cross-sectional view taken along line 15—15 of FIG. 14.

In other embodiments as shown in FIGS. 14 and 15, the pocket portion 136 may be substantially spatially coextensive with the projecting portion 112 such that the opening 110 is disposed substantially parallel to the edge 108 of the stock sheet 102. Accordingly, in these embodiments, the tab 104 may not include a divider portion as described above. As shown, the stock portion 134 may be substantially curvilinear.

Figure 16:
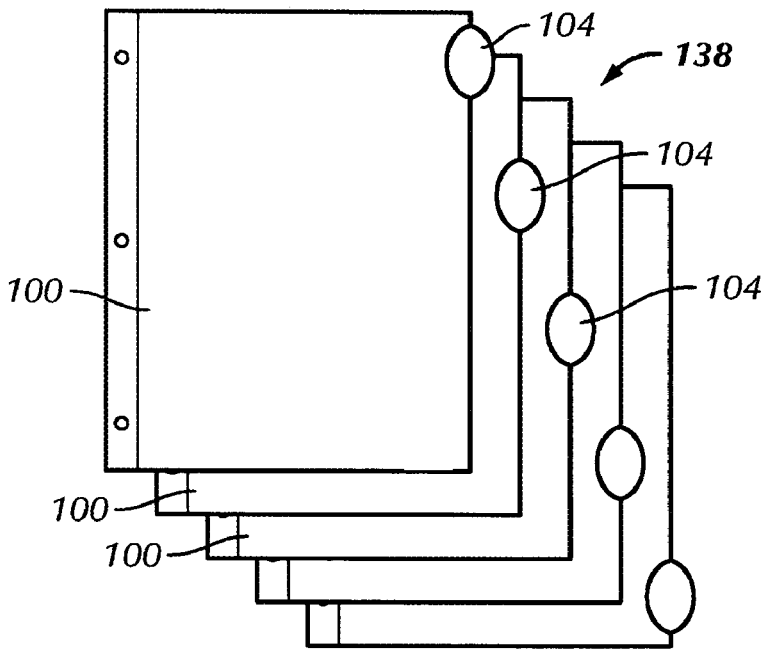
FIG. 16 illustrates a set of sheet dividers.
Figure 17:
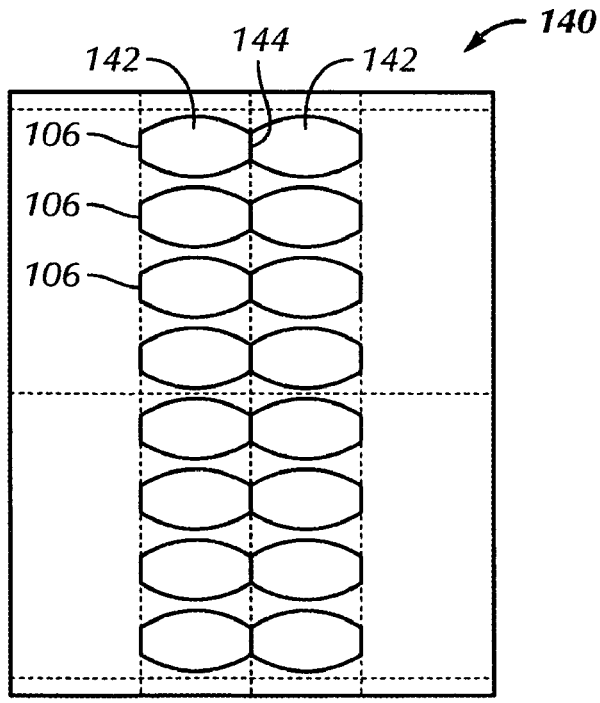
FIG. 17 illustrates a label sheet with a plurality of labels for a set of sheet dividers with tabs.

With reference to FIGS. 16 and 17, a set 138 of sheet dividers includes a plurality of the sheet dividers 100 and a label sheet 140 including a plurality of labels 106. For indexing in a binder, the tab 104 of each of the sheet dividers 100 may be positioned at a staggered longitudinal location along a respective edge. The set 138 of sheet dividers 100 may be configured for binding in any type of bound material, such as a ring binder.

The label sheet 140 may be configured for printing in an office printing machine such that desired text or indicia may be printed on one or more of the labels 106, with the labels 106 being removed from the sheet 140 after printing. In a number of embodiments, each of the labels 106 may be defined by a pair of halves 142 such that when removed from the sheet 140, the halves 142 may be folded about a center line 144 to form a label that is shaped complementary to the tabs 104. Other examples of label sheets that may be utilized with the sheet dividers 100 are disclosed in U.S. Design Application Ser. No. 29/203,580 filed Apr. 15, 2004, the entire contents of which application are incorporated herein by reference.

Figure 18:
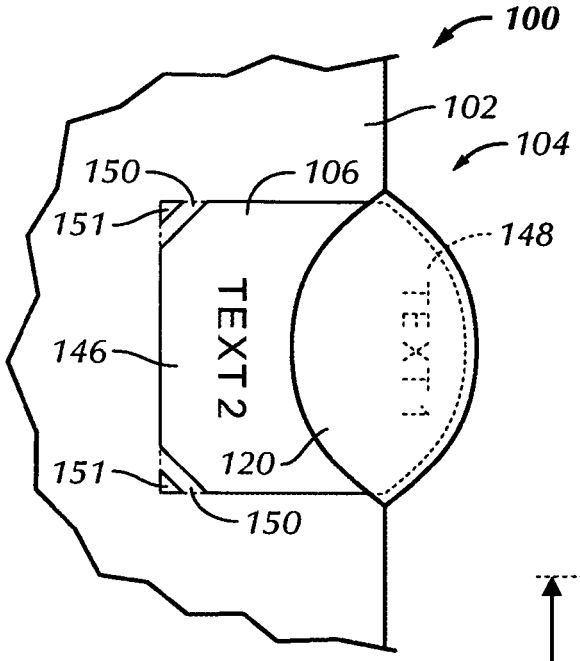
FIG. 18 is a fragmentary plan view of a sheet divider with a tab and an inserted label according to still other embodiments.
Figure 18A:
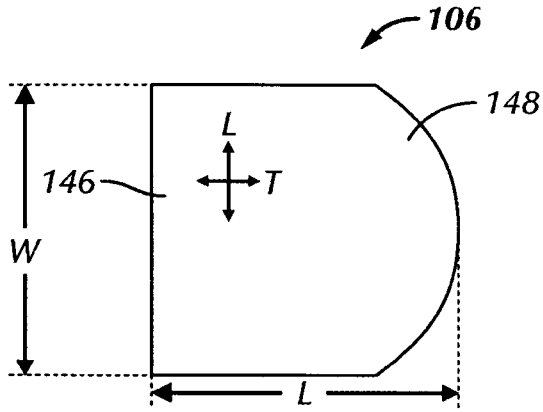
FIG. 18A is a plan view of a label according to a number of embodiments.

In a number of embodiments as represented in FIG. 18, the label 106 may be sufficiently large so that a relatively large amount of text and/or graphics may be printed on the label, particularly on the portion of the label extending proximally over the sheet stock 102. More specifically, as shown in FIG. 18A, the label 108 may have a relatively large transverse length L and/or a relatively large longitudinal width W. In other words, the label 106 may be substantially larger than the tab 104 so that the label projects out through the opening 110 and over the sheet stock 102.

In embodiments with relatively large transverse dimensions, the label 106 may extend proximally beyond the flap 120. In such embodiments, the sheet stock 102 may include retaining structure that is configured to hold or retain a proximal end 146 of the label 106 when a distal end 148 of the label 106 is positioned in the tab 104. More specifically, as shown in FIG. 18, the retaining structure of the sheet stock 102 may include a pair of bands 150 for respectively engaging corners 151 of the proximal end 146 of the label 106. The bands 150 may be die cut into the sheet stock 102 or may be separate elements that are attached to the surface of the sheet stock 102.

Figure 19:
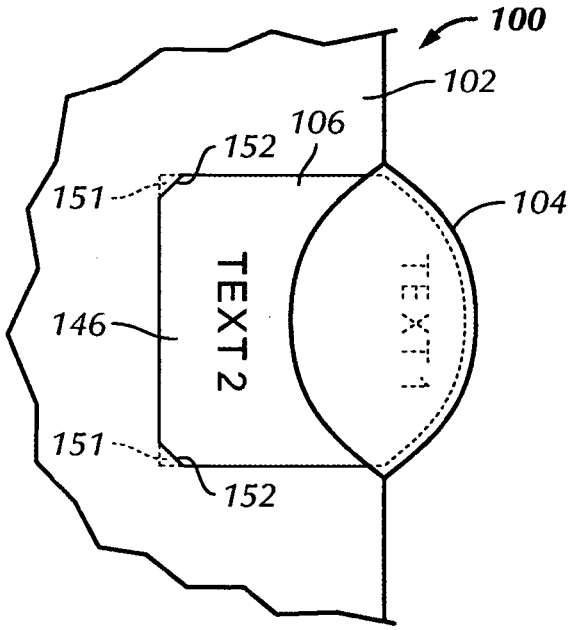
FIG. 19 is a fragmentary plan view of a sheet divider with a tab and an inserted label according to yet still other embodiments.
Figure 20:
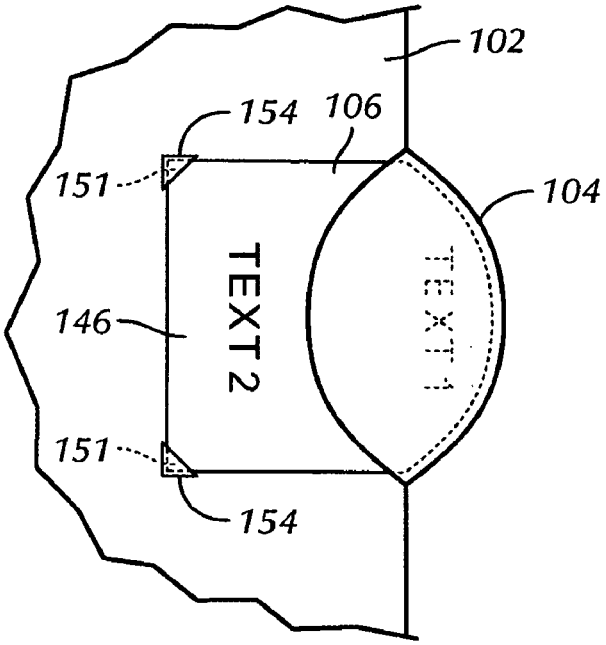
FIG. 20 is a fragmentary plan view of a sheet divider with a tab and an inserted label according to further embodiments.

In other embodiments as shown in FIG. 19, the retaining structure of the sheet stock 102 may include a pair of slits 152 cut therethrough and into which the corners 151 of the proximal end 146 of the label 106 may be inserted. In still other embodiments as shown in FIG. 20, the retaining structure may include a pair of pockets 154 in which the corners 151 are respectively receivable. The pockets 154 may be attached to the surface of the sheet stock 102 by, e.g., adhesive, welding, or other suitable means.

Figure 21:
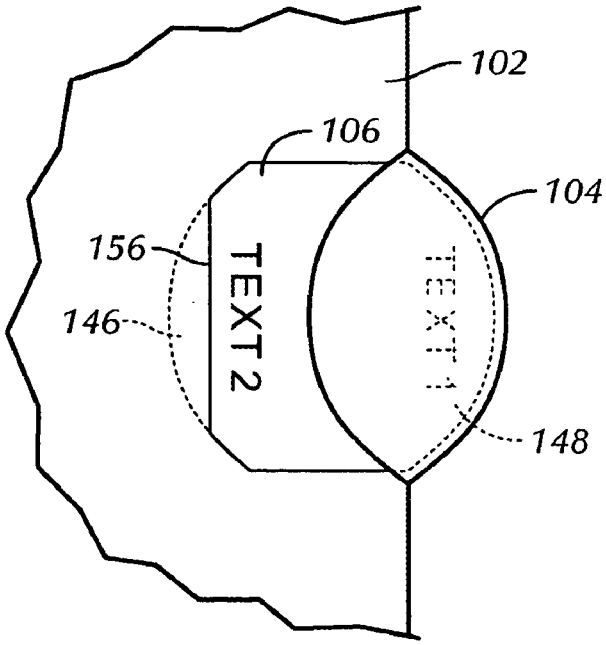
FIG. 21 is a fragmentary plan view of a sheet divider with a tab and an inserted label according to still further embodiments.
Figure 22:
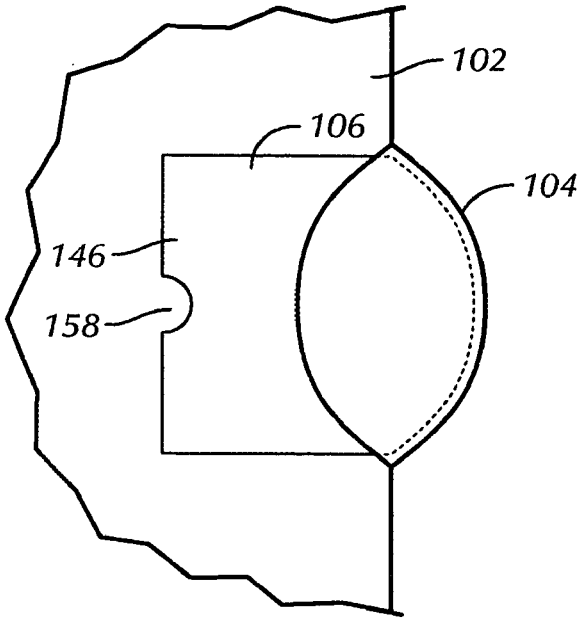
FIG. 22 is a fragmentary plan view of a sheet divider with a tab and an inserted label according to yet still further embodiments.

Referencing FIG. 21, in other embodiments the retaining structure may include a single longitudinal slit 156 cut into the sheet stock 102. In these embodiments, the proximal end 146 of the label 106 may also be curvilinear so as to be retainable within the slit 156. In further embodiments, the retaining structure may include a flap 158 die cut into the sheet stock 102 which may be lifted away from the sheet stock 102 to receive the proximal portion 146 of the label 106.

Figure 23:
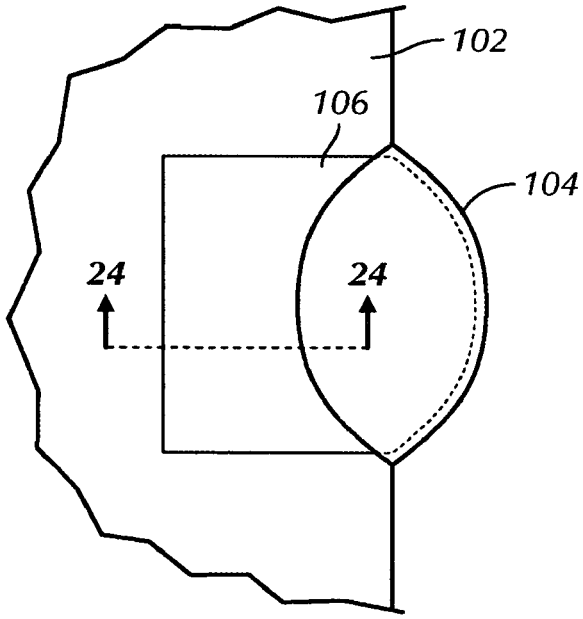
FIG. 23 is a fragmentary plan view of a sheet divider with a tab and an inserted label according to a number of other embodiments.
Figure 24:
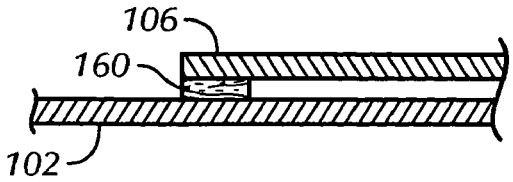
FIG. 24 is a cross-sectional view taken along line 24—24 of FIG. 23.

Rather than utilizing retaining structure on the sheet stock 102, the label 106 may include structure for holding or retaining an edge of the proximal portion 146 of the label to the sheet stock 102. For example, as shown in FIGS. 23 and 24, the label 106 may include a layer of adhesive 160 on a back side of the proximal portion 146 for adhering to the surface of the sheet stock 102. In some of the embodiments, the adhesive 160 may include a low-tack or a pressure-sensitive adhesive so that the label 106 may be peeled away for the sheet stock 102 when removed from the tab 104. In other embodiments, the adhesive 160 may be substantially permanent.

Examples of sizes for the labels 106 depends on the number of tabs 104 desired in the set 138 of sheet dividers 100. For example, the number of tabs 104 in a set 138 of sheet dividers 100 may range from about 3 to about 31, with a typical number ranging between 5 and 10. The labels 106 may then have a longitudinal dimension W adapted to fit inside the pocket 114 formed in the tab 104. An example of the transverse dimension L of the label 106 may extend out to about 3 inches. This dimension provides sufficient space to add a significant amount of additional information to the label 106 beyond what is visible through the distal portion of the tab 104.

In a number of embodiments, the sheet stock 102 and the tabs 104 may be made from a thermoplastic material such as Mylar® and other films to enable the welding of the element together. In other embodiments, the sheet stock 102 may be paper based, with the tab 104, e.g., adhered thereto.

Those skilled in the art will understand that the preceding embodiments of the present invention provide the foundation for numerous alternatives and modifications thereto. These other modifications are also within the scope of the present invention. Accordingly, the present invention is not limited to that precisely as shown and described in the present invention.

What is claimed is:

1. A sheet divider comprising:

a sheet stock having a top edge, a bottom edge, and a pair of side edges with a longitudinal direction defined between the top and bottom edges and a transverse direction defined between the side edges; and a tab disposed at one of the side edges, the tab including:

a stock portion that extends in the transverse direction beyond the side edge of the sheet stock at which the tab is disposed to an outer edge; and a pocket portion at least partially coupled to the stock portion at least proximate the stock portion outer edge, the pocket portion extending, in the transverse direction, from the stock portion outer edge to a position that is less than halfway between the pair of side edges, and including a divider portion that is positioned over a portion of the sheet stock;

the stock portion and the pocket portion forming a pocket having a single opening that opens toward the sheet stock and that extends substantially in the longitudinal direction such that a label is insertable into the pocket in the transverse direction, and the divider portion including a flap that is liftable away from the sheet stock.

2. The sheet divider of claim 1 wherein the opening has a length that is longer in the longitudinal direction than a width of the stock portion in the transverse direction.

3. The sheet divider of claim 1 further comprising a label that is shaped complementary to the stock portion and the divider portion such that when received in the pocket, the label extends under the flap of the divider portion.

4. The sheet divider of claim 3 wherein the flap has a notch that provides access to the label when received in the pocket.

5. The sheet divider of claim 3 wherein at least the stock portion is curvilinear.

6. The sheet divider of claim 1 further comprising a label including a distal portion that is receivable in the pocket and a proximal portion that extends transversely over the sheet stock when the distal portion is received in the pocket.

7. The sheet divider of claim 6 wherein the sheet stock includes retaining structure for holding the proximal portion to the sheet stock.

8. The sheet divider of claim 7 wherein the proximal portion of the label has a pair of corners and the retaining structure is configured to engage with the corners of the proximal portion of the label.

9. The sheet divider of claim 8 wherein the retaining structure includes a pair of slits cut into the sheet stock for respectively receiving corners of the proximal portion of the label.

10. The sheet divider of claim 6 wherein the proximal portion of the label includes a layer of adhesive that is adherent to the sheet stock when the distal portion is received in the pocket.

11. The sheet divider of claim 1 wherein:

the stock portion includes a curvilinear portion and a rectilinear portion; and the rectilinear portion is positioned between the curvilinear portion and the sheet stock.

12. The sheet divider of claim 11 wherein the opening is formed in the curvilinear portion.

13. The sheet divider of claim 1 wherein the stock portion is substantially arcuate.

14. A sheet divider comprising:

a sheet stock having a pair of edges; and a curvilinear-shaped tab disposed at one of the edges of the sheet stock and having a single opening that is located inside the edge of the sheet stock at which the tab is disposed and that opens toward the sheet stock and that enables a label to be inserted into the tab from a direction that is substantially perpendicular to the edge of the sheet stock at which the tab is disposed, the tab including:

a stock portion that extends transversely beyond the edge at which the tab is disposed to an outer edge, and a pocket portion at least partially coupled to the stock portion at least proximate the stock portion outer edge, the pocket portion transversely extending from the stock portion outer edge to a position that is less than halfway between the pair of stock sheet edges, said pocket portion including a flap that is able to be lifted away from the sheet stock.

15. The sheet divider of claim 14 wherein the opening enables a label to be inserted into the tab from a direction of the sheet stock.

16. The sheet divider of claim 14 wherein the opening has a length that is longer than a width of the stock portion.

17. The sheet divider of claim 14 wherein the tab has a notch formed in the pocket portion that provides access to a label received in the tab.

18. The sheet divider of claim 14 further comprising the label.

19. The sheet divider of claim 18 wherein the label is larger than the tab such that the label projects out through the opening and over the sheet stock when the label is received in the tab.

20. The sheet divider of claim 18 wherein the label includes a distal portion that is receivable in the tab and a proximal portion that extends over the sheet stock when the distal portion is received in the tab.

21. The sheet divider of claim 20 wherein the sheet stock includes retaining structure for holding the proximal portion to the sheet stock.

22. The sheet divider of claim 21 wherein the proximal portion of the label has a pair of corners and the retaining structure is configured to engage with the corners of the proximal portion of the label.

23. A set of sheet dividers comprising:

a label sheet including a plurality of labels; and a plurality of sheet dividers, each of the sheet dividers including:

a sheet stock having a pair of edges; and a tab disposed at one of the edges of the sheet stock and having a single opening that opens toward the sheet stock and that enables one of the labels to be inserted into the tab from a direction that is substantially perpendicular to the edge of the sheet stock at which the tab is disposed, the tab including:

a stock portion that extends transversely beyond the edge at which the tab is disposed to an outer edge, and a pocket portion at least partially coupled to the stock portion at least proximate the stock portion outer edge, the pocket portion transversely extending from the stock portion outer edge to a position that is less than halfway between the pair of stock sheet edge, and including a divider portion that is positioned over a portion of the sheet stock, the divider portion including a flap that is liftable away from the sheet stock.

24. The set of sheet dividers of claim 23 wherein at least the stock portion of each of the tabs is substantially curvilinear and each of the labels of the label sheet is configured complementarily to at least the stock portion of the tab.

25. The sheet divider of claim 23 wherein each of the labels includes a distal portion that is receivable in the pocket of one of the sheet dividers and a proximal portion that extends over the sheet stock when the distal portion is received in the pocket.

26. The sheet divider of claim 25 wherein the sheet stock of each of the dividers includes retaining structure for holding the proximal portion a label to the sheet stock when the distal portion of the label is received in the pocket.

* * * * *

UNITED STATES PATENT AND TRADEMARK OFFICE

CERTIFICATE OF CORRECTION

PATENT NO. : 7,125,050 B2
APPLICATION NO. : 10/965437
DATED : October 24, 2006
INVENTOR(S) : Norman C. Yamamoto et al.

It is certified that error appears in the above-identified patent and that said Letters Patent is hereby corrected as shown below:

Column 9, line 9, "edge" should be changed to --edges--.

Signed and Sealed this

Fifteenth Day of April, 2008

JON W. DUDAS
*Director of the United States Patent and Trademark Office*